US005626197A

United States Patent [19]

Tseng

[11] Patent Number: 5,626,197

[45] Date of Patent: May 6, 1997

[54] ROAD SCRAPER HAVING VERTICALLY AND HORIZONTALLY DISPLACEABLE AUXILIARY SCRAPING DEVICE

[76] Inventor: An-Ping Tseng, 6F, No. 630-10, Ta You Road, Taoyuan, Taiwan

[21] Appl. No.: 585,625

[22] Filed: Jan. 16, 1996

[51] Int. Cl.[6] ..... E02F 3/76

[52] U.S. Cl. ..... 172/815; 172/540; 172/554; 404/90; 299/71; 299/73

[58] Field of Search ..... 172/815, 523, 172/540, 554; 299/39.1, 39.5, 39.6, 71, 73; 404/90

[56] References Cited

U.S. PATENT DOCUMENTS

| | | | |
|---|---|---|---|
| 4,704,045 | 11/1987 | Taylor et al. | 404/90 |
| 4,714,374 | 12/1987 | Mihara | 299/39.5 X |
| 4,808,026 | 2/1989 | Clarke, Jr. et al. | 299/39.5 X |
| 4,878,713 | 11/1989 | Zanetis | 299/39.5 |
| 4,884,848 | 12/1989 | Wrulich et al. | 299/73 |
| 4,900,094 | 2/1990 | Sergeant | 299/39.6 |
| 5,101,583 | 4/1992 | Scordilis | 299/39.8 X |
| 5,203,615 | 4/1993 | Zanetis et al. | 299/73 X |
| 5,378,081 | 1/1995 | Swisher, Jr. | 299/39.5 |
| 5,382,084 | 1/1995 | Diver et al. | 299/39.5 |

*Primary Examiner*—Terry Lee Melius
*Assistant Examiner*—Victor Batson
*Attorney, Agent, or Firm*—Birch, Stewart, Kolasch & Birch, LLP

[57] ABSTRACT

An improved road scraper includes a second scraping device mounted at a rear end of a road scraper of a known construction having a first scraping device. Between the road scraper and the second scraping device are disposed a vertical displacement mechanism and a horizontal displacement mechanism. By the actions of these mechanisms, the second scraping device may be extended outwardly from one side of the road scraper for scraping a greater width of the road.

4 Claims, 5 Drawing Sheets

ROAD SCRAPER HAVING VERTICALLY AND HORIZONTALLY DISPLACEABLE AUXILIARY SCRAPING DEVICE

BACKGROUND OF THE INVENTION (a) Field of the Invention

The present invention relates generally to a road scraper, and more particularly to an improved road scraper for effectively scraping a greater width of a road.

(b) Description of the Prior Art

Existing road scrapers are largely comprised of a scraping device having a suitable width mounted at a rear end of a removable car body. The scraping device may scrape a determined width of the road with the forward movement of the car body. Such road scrapers are widely used in the field and have achieved quite satisfactory effects. However, since the width of the car body onto which the scraping device is mounted is fixed, the width of the scraping device is restricted by the fixed width of the car body. Under such restrictive conditions, the conventional road scrapers can only scrape a limited width of the road. In other words, in order to scrape a comparatively wider road, the road scraper has to run back and forth on the same road several times more, and hence the time taken to accomplish the scraping job will be prolonged. Such problems also exist if a road to be scraped is slightly wider than the width of the road scraper or the width of the road is irregular, with some areas wider or narrower.

SUMMARY OF THE INVENTION

A primary object of the present invention is to provide an improved road scraper, in which a second scraping device is mounted at a rear end of a first scraping device so that the second scraping device may, by means of a vertical displacement mechanism and a horizontal displacement mechanism disposed between the first and the second scraping devices, generate upward and downward as well as lateral displacement actions, achieving the effects of scraping a greater width of the road at each operation.

Another object of the present invention is to provide an improved road scraper comprising a second scraping device which may laterally displaced to a suitable extent so that it may be used on roads of irregular width to achieve more efficient and time-saving scraping operations. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
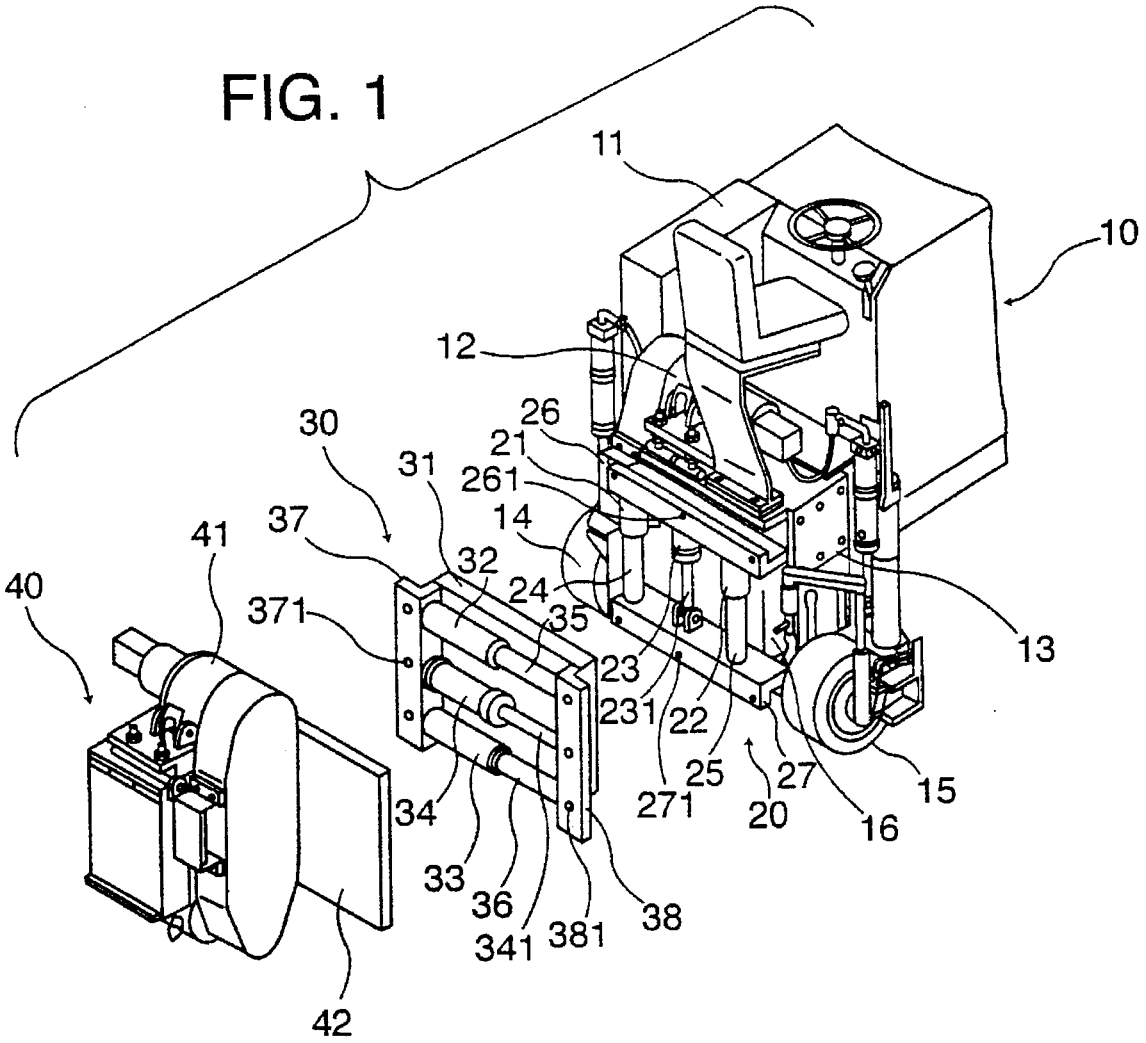
FIG. 1 is a perspective exploded view of an improved road scraper of the present invention.

As shown in the drawings, the improved road scraper according to the present invention essentially comprises a scraper 10 of the conventional type, a vertical displacement mechanism 20 mounted to a rear end of the road scraper 10, a horizontal displacement mechanism 30 and a second scraping device 40. The scraper 10 consists of a removable car body 11 and a first scraping device 13 actuated by an oil pressure motor 12 and disposed at a rear end of the car body 11, the first scraping device 13 having a couple of liftable wheels 14, 15 respectively disposed at two lateral sides thereof for lifting the first scraping device off the ground or lowering the first scraping device 13 on the ground to perform scraping actions. A substantially rectangular tail plate 16 is mounted at a rear end of the first scraping device 13.

The vertical displacement mechanism 20 includes two vertical sleeves 21, 22 suitably positioned at two outer sides of a surface of the tail plate 16 on the scraper 10, and a vertical oil cylinder 23 disposed between the sleeves 21, 22 at equal distances therefrom. The vertical sleeves 21, 22 are respectively fitted with slide rods 24, 25 of equal lengths. The upper ends and lower ends of the vertical sleeves 21, 22 are respectively connected to an upper horizontal positioning seat 26 and a lower horizontal positioning seat 27 at suitable positions. The vertical oil cylinder 23 has a piston 231 which has an outer end pivotally connected to an inner side of the lower horizontal positioning seat 27 at a suitable position. In addition, a plurality of screw holes 261, 271 are respectively provided in the upper horizontal positioning seat 26 and the lower horizontal positioning seat 27 which are oriented towards the rear.

Figure 5A:
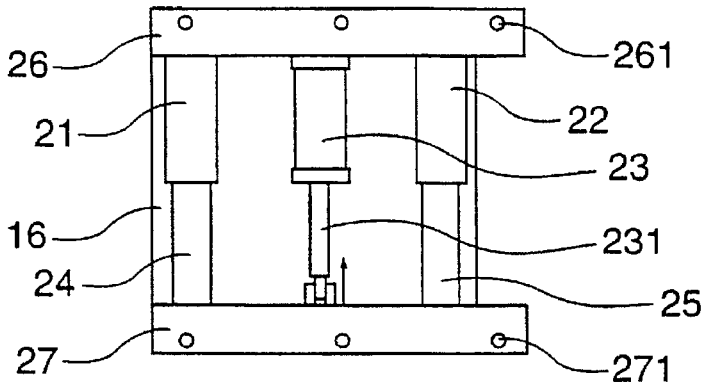
FIG. 5A shows a vertical displacement mechanism of the second scraping device of the invention in a first position.
Figure 5B:
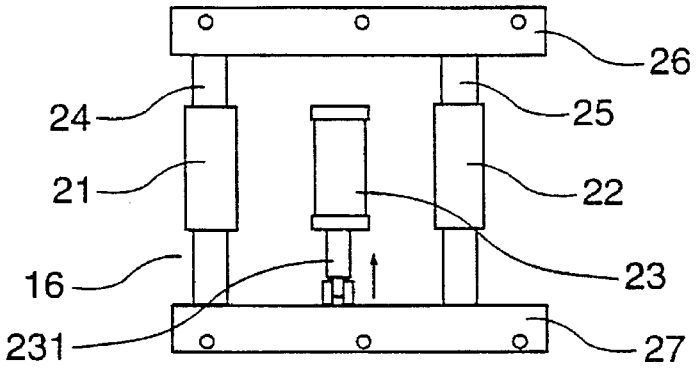
FIG. 5B shows the vertical displacement mechanism of the second scraping device of the invention in a second position.
Figure 5C:
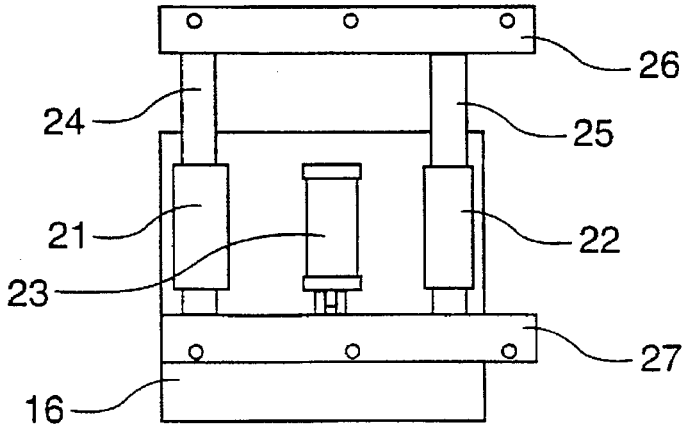
FIG. 5C shows the vertical displacement mechanism of the second scraping device of the invention in a third position.

FIGS. 5A, 5B and 5B illustrates the action of the vertical displacement mechanism 20. When the piston 231 is actuated by the vertical cylinder 23 to retract inwardly, the lower horizontal positioning seat 27 will be pushed by the piston 231 to displace upwardly. Since the lower horizontal positioning seat 27 is connected to the upper horizontal positioning seat 26 via the slide rods 24, 25 of the vertical sleeves 21, 22, the upper horizontal positioning seat 26 is displaced upwardly with the lower horizontal positioning seat 27 in a synchronous manner. And when the piston 231 has retracted to a critical limit, the upper horizontal positioning seat 26 and the lower horizontal positioning seat 27 have also displaced to a highest position (as shown in FIG. 5C). On the contrary, when the piston 231 is caused to extend outwardly, pushing the lower horizontal positioning seat 27 to displace downwardly, the upper horizontal positioning seat 26 is also caused to displace downwardly in a synchronous manner, as shown in FIG. 5A. In other words, the upper horizontal positioning seat 26 and the lower horizontal positioning seat 27 are displaced to a lowest position.

The horizontal displacement mechanism 30 includes a vertical plate 31 for securement to the upper and lower horizontal positioning seats 26 and 27 of the vertical displacement mechanism 20. The vertical plate 31 may synchronously be displaced upwardly or downwardly with the upper and lower horizontal positioning seats 26, 27. Two horizontal sleeves 32, 33 are disposed at two outer sides of the surface of the vertical plate 31 at suitable positions, with a horizontal oil cylinder 34 provided between the horizontal sleeves 32, 33 at equal distances therefrom. The horizontal sleeves 33 are respectively fitted with slide rods 35, 36. Both ends of these slide rods 35, 36 are respectively secured to inner sides of a left vertical positioning seat 37.and a right vertical positioning seat 38 at suitable positions. Additionally, the horizontal oil cylinder 34 has a piston 341 which has an outer end pivotally connected to an inner side of the right vertical positioning seat 38 at a suitable position. A plurality of screw holes 371 and 381 are respectively provided in the left and right positioning seats 37, 38 which are oriented towards the rear.

The vertical plate 31 is connected to the upper and lower horizontal positioning seats 26 and 27 by means of a plurality of screws (not shown) so that they are respectively driven into the screw holes 271. The screws are then driven into a front surface into the vertical plate 31 at suitable positions.

The action of the horizontal displacement mechanism 30 is similar to that of the vertical displacement mechanism 20 illustrated in FIGS. 5A, 5B and 5C. Schematic views illustrating the action of the horizontal displacement mechanism 30 may be obtained by turning the sheet of drawing counterclockwise through 90 degrees. In brief, when the oil cylinder 34 causes the piston 341 to retract or extend, the left and right vertical positioning seats 37, 38 are caused to displaced synchronously to the left or right.

The second scraping device 40 has a width smaller than that of the first scraping device 30. The second scraping device 40 has an oil pressure motor 41 which is disposed at a position opposite to that of the oil pressure motor 21 of the first scraping device 13. The second scraping device 40 is provided with a vertical side plate 42 at its inner side, such that when a plurality of screws (not shown) are respectively driven through a plurality of screw holes 371 in the left vertical positioning seat 37 and a plurality of screw holes 381 in the right vertical positioning seat 38, the screws are individually located at a front side of the vertical side plate 42 at suitable positions. Hence, the vertical side plate 42 of the second scraping device 40 and the left and right vertical positioning seats 37, 38 may be secured together as a whole. Additionally, since the vertical displacement mechanism 20 is connected to the first scraping device 13 as a whole, and the horizontal displacement mechanism 30 is also connected to the vertical displacement mechanism 20 as a whole, by means of their connection, the second scraping device 40 may be securely suspended at the rear end of the first scraping device 13.

Figure 2:
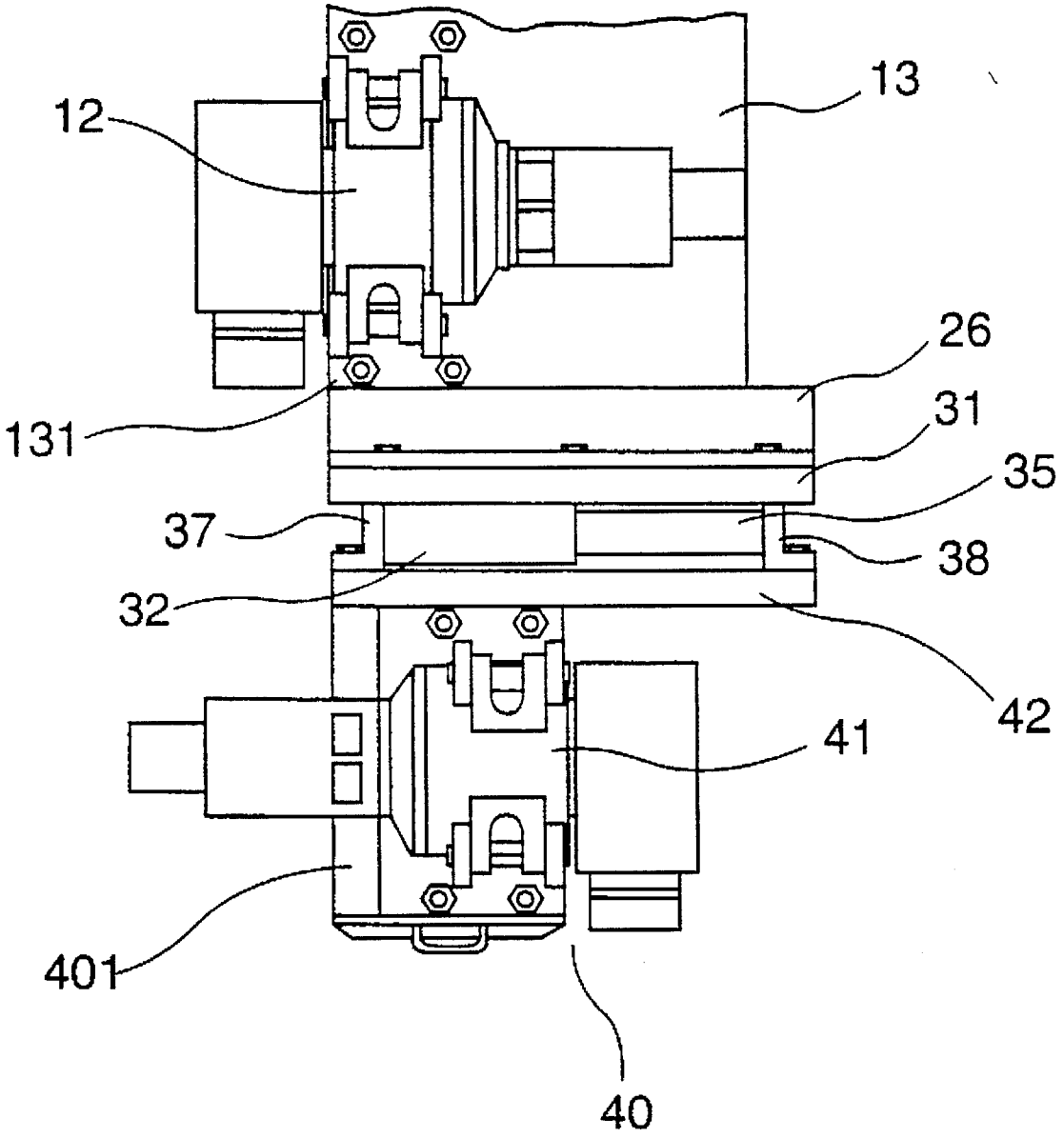
FIG. 2 is a top view of the improved road scraper according to the present invention.
Figure 3:
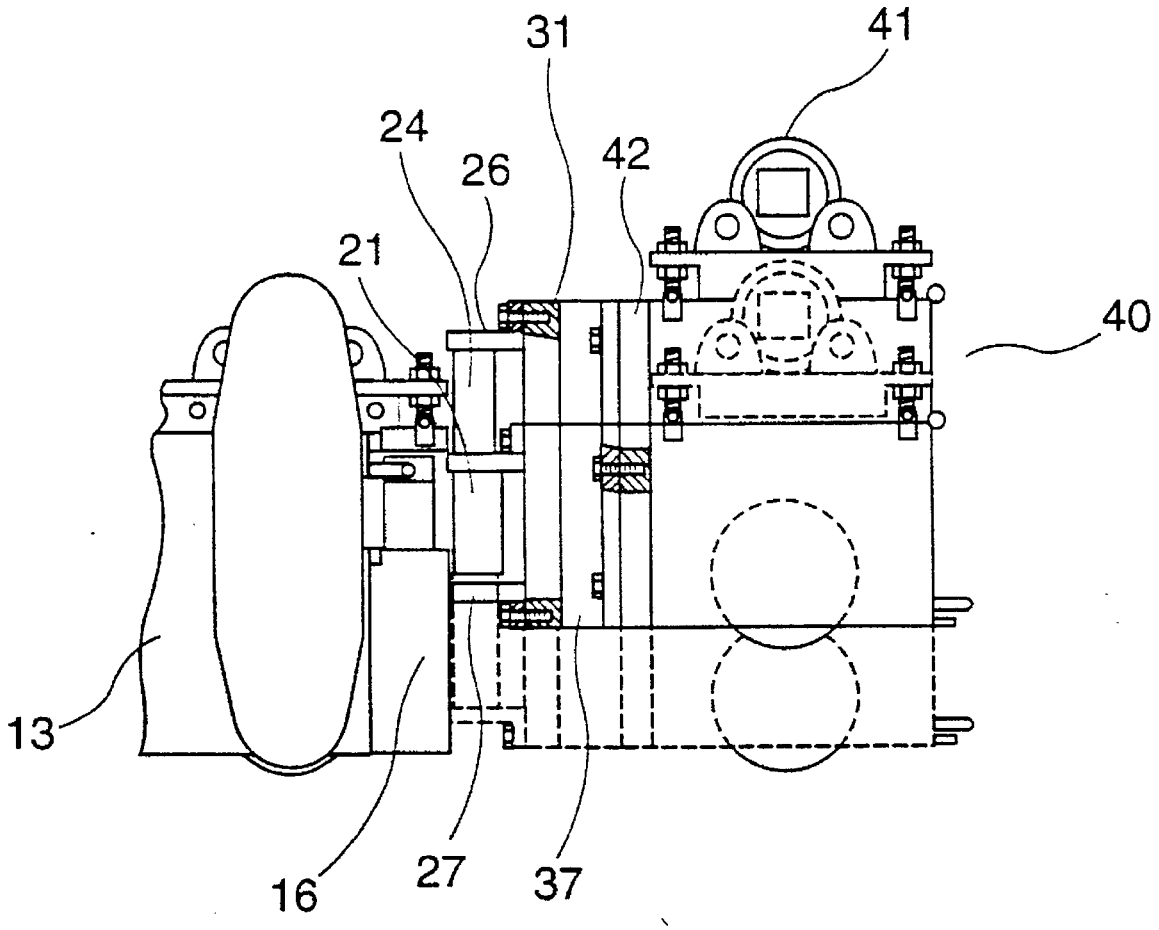
FIG. 3 is a schematic view of a second scraping device of the improved road scraper of the present invention, illustrating the vertical displacement thereof.

With reference to FIG. 2 in which the second scraping device 40 is shown not to have extended to the side, a left side 131 of the first scraping device 13 is substantially in alignment with a left side 401 of the second scraping device 40. Therefore, when the vertical displacement mechanism 20 is operated to displace upwardly, the second scraping device 40 will synchronously displace upwardly. In FIG. 3, the scraping device 40 is illustrated by solid lines displaced to a highest position. At such a position, the second scraping device 40 will not perform scraping actions since it is not in contact with the ground surface. In general, when the second scraping device 40 is elevated to a high position and the space therebelow is large enough, simple maintenance and repair of the second scraping device 40 or the first scraping device 13 may proceed in that space. Obviously, the second scraping device 40 may be removed from the road scraper for more complicated maintenance and repair work to be done on the second scraping device 40 itself or the first scraping device 13.

Moreover, when the vertical displacement mechanism 20 displaces downwardly, causing the second scraping device 40 to displace downwardly to a position shown by imaginary lines in FIG. 3, since the second scraping device 40 at this point is in contact with the ground surface, it may perform scraping actions.

Figure 4:
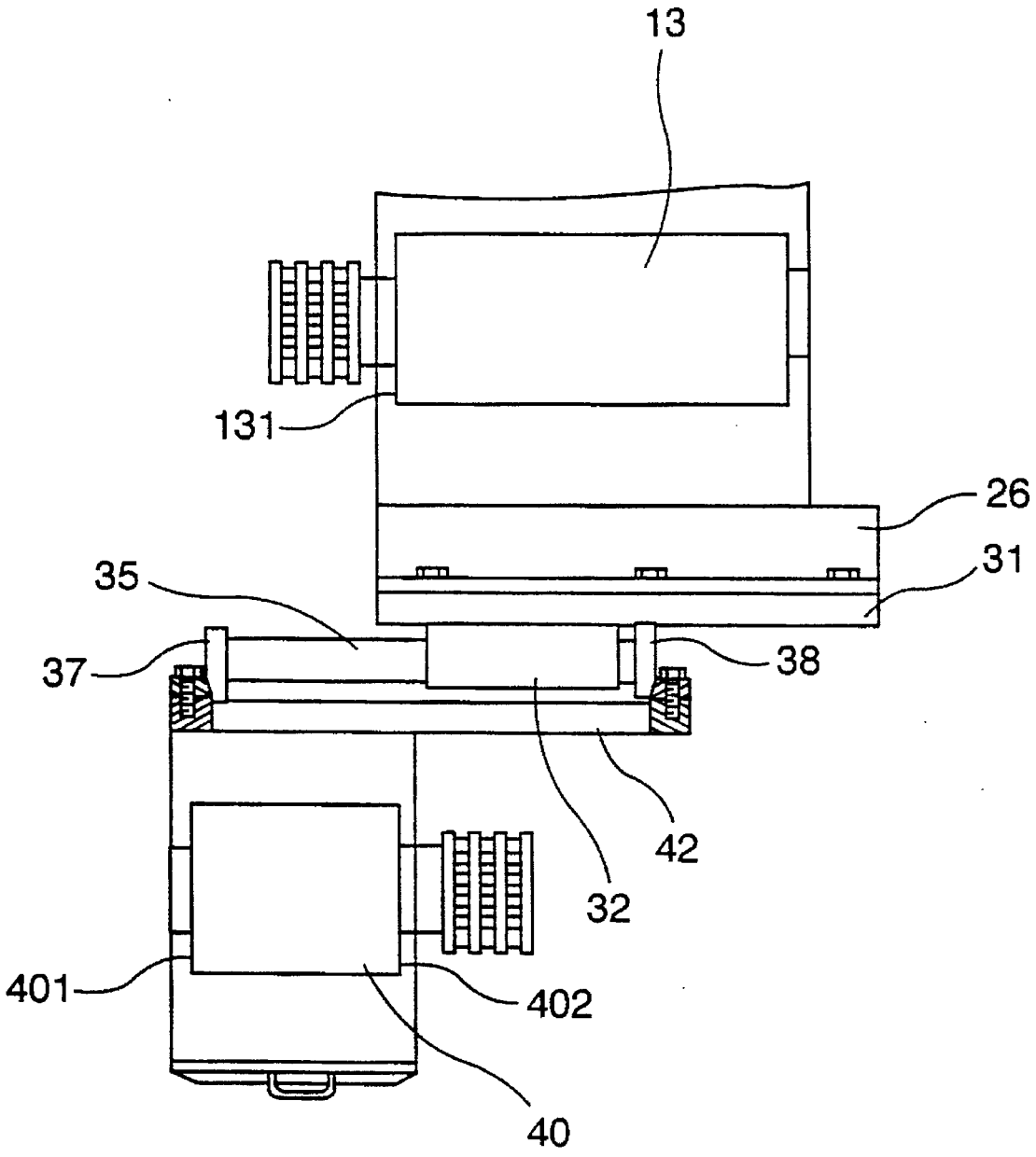
FIG. 4 is a schematic view of the second scraping device of the improved road scraper according to the present invention, illustrating the horizontal displacement thereof.

With further reference to FIG. 4, when the horizontal displacement mechanism 30 is driven to displace to the left, the second scraping device 40 will gradually change in position from that shown in FIG. 2 to that shown in FIG. 4. In other words, the second scraping device is displaced from one position in which the left side 401 of the second scraping device 40 is in alignment with the left side 131 of the first scraping device 13, to the other position in which the right side 402 of the second scraping device 40 is in alignment with the left side 131 of the first scraping device 13. Therefore, by utilizing the horizontal displacement mechanism 30 to cause the second scraping device 40 to displace leftwise to a suitable extent and by utilizing the vertical displacement mechanism 20 to cause the second scraping device 40 to be in contact with the ground surface, the left side 131 of the first scraping device 13 is virtually extended to a suitable extent for performing a more extensive scraping action.

In the present invention, the right side 402 of the second scraping device 40 is caused to be in alignment with the left side 131 of the first scraping device 13 for restricting the leftwise displacement of the second scraping device 40. The purpose of this arrangement is to prevent the second scraping device 40 from displacing too much to the left, which may cause a gap to which the scraping action cannot be extended to be formed between the second scraping device 40 and the first scraping device 13.

As the second scraping device 40 of the present invention is configured to be capable of leftwise displacement, if the width thereof is 40 cm, the first scraping device 13 will virtually have an additional width of 40 cm, meaning that a greater width of the road may be scraped. In addition, when the present invention is employed in scraping a road of irregular widths, the second scraping device 40 may be controlled to extend or retract according to the width of the road so that the scraping operation may be performed in a most efficient and time-saving manner.

In view of the aforesaid, effective road scraping operations may be achieved by means ;of the vertical displacement mechanism, horizontal displacement mechanism and the second scraping device according to the present invention, in which the second scraping device may be extended or retracted to scrape wider road surfaces or roads of irregular widths.

Although the present invention has been illustrated and described with reference to the preferred embodiment thereof, it should be understood that it is in no way limited to the details of such embodiment but is capable of numerous modifications within the scope of the appended claims.

What is claimed is:

1. A road scraper comprising:

a scraper including a removable car body and a first scraping device mounted at a rear end thereof and driven by an oil pressure motor, said first scraping device having two liftable wheels disposed at two lateral sides thereof for lifting said first scraping device above the ground surface or lowering said first scraping device onto the ground surface to perform scraping actions, said first scraping device further having a tail plate disposed at a rear end thereof;

a vertical displacement mechanism including two vertical sleeves disposed at spaced-apart outer sides of a surface of said tail plate of said first scraping device, and a vertical oil cylinder securely located between said two vertical sleeves and equidistant therefrom, said two vertical sleeves being respectively provided with vertical slide rods of equivalent lengths, each of said vertical slide rods having two ends respectively secured onto inner sides of an upper horizontal positioning seat and a lower horizontal positioning seat, said vertical oil cylinder being provided with a piston which has an outer end pivotally connected to the inner side of the horizontal positioning seat;

a horizontal displacement mechanism including a vertical plate for securement to said upper horizontal positioning seat and said lower horizontal positioning seat of said vertical displacement mechanism, said vertical plate being provided with two spaced-apart horizontal sleeves disposed at outer sides of a surface thereof, and a horizontal oil cylinder securely located between said two horizontal sleeves and equidistant therefrom, said horizontal sleeves being respectively provided with horizontal slide rods of equivalent lengths, each of said horizontal slide rods having two ends respectively secured onto inner sides of a left vertical positioning seat and a right vertical positioning seat, said horizontal oil cylinder being provided with a piston which has an outer end pivotally connected to the inner side of the right vertical positioning seat; and a second scraping device having a width smaller than that of said first scraping device, and an oil pressure motor oriented towards a direction opposite to that of said oil pressure motor of said first scraping device, said second scraping device being provided with a vertical side plate at an inner side thereof for securement to said right vertical positioning seat and said left vertical positioning seat, wherein by actions of said vertical displacement mechanism and said horizontal displacement mechanism, said second scraping device may extend from a lateral side of said road scraper to scrape road surfaces.

2. The road scraper according to claim 1, wherein said vertical displacement mechanism and said horizontal displacement mechanism are independently operable.

3. The road scraper according to claim 1, wherein said second scraping device is positionable by said horizontal displacement mechanism to a position where a left side of the second scraping device is in alignment with a left side of said first scraping device.

4. The road scraper according to claim 1, wherein said second scraping device is positionable by said horizontal displacement mechanism to a position where a right side of the second scraping device is in alignment with a left side of said first scraping device.

* * * * *